US008272798B2

(12) United States Patent
Yoshioka

(10) Patent No.: US 8,272,798 B2
(45) Date of Patent: Sep. 25, 2012

(54) PRINTER

(75) Inventor: Yukio Yoshioka, Kawasaki (JP)

(73) Assignee: NEC Infrontia Corporation, Kawasaki-shi (JP)

( * ) Notice: Subject to any disclaimer, the term of this patent is extended or adjusted under 35 U.S.C. 154(b) by 1089 days.

(21) Appl. No.: 12/182,616

(22) Filed: Jul. 30, 2008

(65) Prior Publication Data

US 2009/0035045 A1 Feb. 5, 2009

(30) Foreign Application Priority Data

Jul. 31, 2007 (JP) ..... 2007-198422

(51) Int. Cl.
*B41J 3/39* (2006.01)
*B41J 29/02* (2006.01)
*B41J 11/00* (2006.01)

(52) U.S. Cl. ..... 400/691; 400/621; 400/692; 400/693; 347/22

(58) Field of Classification Search ..... 400/621, 400/625, 691, 692, 693, 586; 347/22
See application file for complete search history.

(56) References Cited

U.S. PATENT DOCUMENTS 7,002,612 B2 * 2/2006 Imai et al. ..... 347/215
2005/0232678 A1 * 10/2005 Mochizuki et al. ..... 400/621
2006/0008312 A1 * 1/2006 Sago et al. ..... 400/642

FOREIGN PATENT DOCUMENTS

| | | | |
|---|---|---|---|
| JP | 6-166230 | A | 6/1994 |
| JP | 9-128655 | A | 5/1997 |
| JP | 2000-103566 | A | 4/2000 |
| JP | 2000-310848 | A | 11/2000 |
| JP | 2001-310848 | A | 11/2001 |
| JP | 2002-86827 | A | 3/2002 |

* cited by examiner

*Primary Examiner* — Daniel J Colilla
*Assistant Examiner* — Marissa Ferguson Samreth
(74) *Attorney, Agent, or Firm* — Sughrue Mion, PLLC

(57) ABSTRACT

In a printer which prints on a roll paper transported toward a discharge port and cuts the roll paper, an exchangeable lower cover is attached to the printer. The exchangeable lower cover defines a lower edge of the discharge port. A change of height of the discharge port is allowed by exchanging the exchangeable lower cover for another one. Hereby, it is possible to change specifications between one for holding a printed slip and the other for allowing the printed slip to fall freely. In the former specification, a brush provided at a periphery of an upper edge of the discharge port is in contact with a lower cover. On the other hand, in the latter specification, the brush is in distant from another lower cover.

6 Claims, 4 Drawing Sheets

PRINTER

This application is based upon and claims the benefit of priority from Japanese patent application No. 2007-198422, filed on Jul. 31, 2007, the disclosure of which is incorporated herein in its entirety by reference.

BACKGROUND OF THE INVENTION

This invention relates to a printer, particularly, to a printer which prints on a roll paper and cuts the roll paper to discharge the printed slip to an exterior thereof.

A related printer, as shown in FIG. 1, is provided with a printing portion 11, a cutter mechanism 12 and a discharge port 13, which are arranged along a transporting route 14 of a roll paper 15 (only an unrolled part is shown while a paper roll is not shown).

The printer executes a print operation by using the printing portion 11 while transporting the roll paper 15 toward the discharge port 13. Subsequently, the printer further carries the roll paper 15 to put a printed part of the roll paper 15 on a downstream position of the transporting route 14 with regard to the cutter mechanism 12. Then the printer cuts the roll paper 15 by the cutter mechanism 12 to separate the printed part. Hereby, the printed part, which is a part of the roll paper 15, is discharged as the printed slip (e.g. as a receipt) from the discharge port 13 to the exterior of the printer.

Generally, the discharge port 13 is a mere opening. However, the printer illustrated in FIG. 1 is provided with a brush 16 near (or inside) the discharge port 13 to hold the printed slip. The brush 16 is attached to a cover 17 so that the tip of the brush 16 is in contact with a guide plate 18 which defines a lower edge of the discharge port 13. The brush 16 holds the roll paper 15 (or the printed slip), which is transported along the guide plate 18, together with the guide plate 18.

Such a printer is disclosed in Japanese Laid-Open Patent Publication No. 2001-310848.

Regarding a printer for a receipt, there are two demands. One is that a printed slip can be held at a discharge port and the other is that a printed slip can fall freely without being held at the discharge port. In a case where two different type printers are manufactured to meet these conflicting demands, according simple arithmetic, double costs are required in comparison with a case of manufacturing only one type. Accordingly, it is desired that common parts are used in the two different type printers as much as possible.

The related printer mentioned above is provided with the brush near the discharge port to hold the printed slip. The brush is merely attached to an inside of the cover, which defines an upper edge of the discharge port, by a double-faced adhesive tape. Accordingly, the brush is easily detached from the cover. However, in many cases, the printed slip cannot fall freely even if the brush is detached from the cover. This is because the brush is not for holding the roll paper which may fall but for preventing the roll paper from turning back by resilience of a remaining rolled shape.

On the other hand, in a case where a brush is attached to another printer designed for a free fall of a printed slip, there is a problem that it is impossible to hold a printed slip certainly without impeding transportation of a roll paper.

SUMMARY OF THE INVENTION

It is therefore an object of this invention to provide a printer of which specifications can be easily changed by exchanging only one part between one that a printed slip is certainly held at a discharge port and the other that the printed slip falls freely without being held by the discharge port.

To achieve the object, according to an aspect of the present invention, a printer prints on a roll paper transported toward a discharge port and cuts the roll paper. The printer includes an exchangeable lower cover which defines a lower edge of the discharge port. A change of height of the discharge port is allowed by exchanging the exchangeable lower cover for another one.

Particularly, the printer further includes a brush which is provided to a periphery of an upper edge of the discharge port and which projects into the discharge port. A first lower cover to be in contact with the brush and a second lower cover to be distant from the brush are selectively attached to the printer as the exchangeable lower cover.

According to another aspect of the present invention, a specification changing method of a printer which prints on a roll paper transported toward a discharge port and which cuts the roll paper includes a step of exchanging an exchangeable lower cover defining a lower edge of the discharge port for another one to change height of the discharge port, and thereby changing specifications of the printer between one for holding a cut roll paper and the other for allowing the cut roll paper to fall freely.

According to the present invention, since height of a discharge port of a printer can be changed by exchanging an exchangeable lower cover defining a lower edge of the discharge port for another one, it is easily possible to change specifications of the printer between one for holding a printed slip certainly and the other for allowing the printed slip to fall naturally surely.

DESCRIPTION OF THE PREFERRED EMBODIMENT

Figure 2:
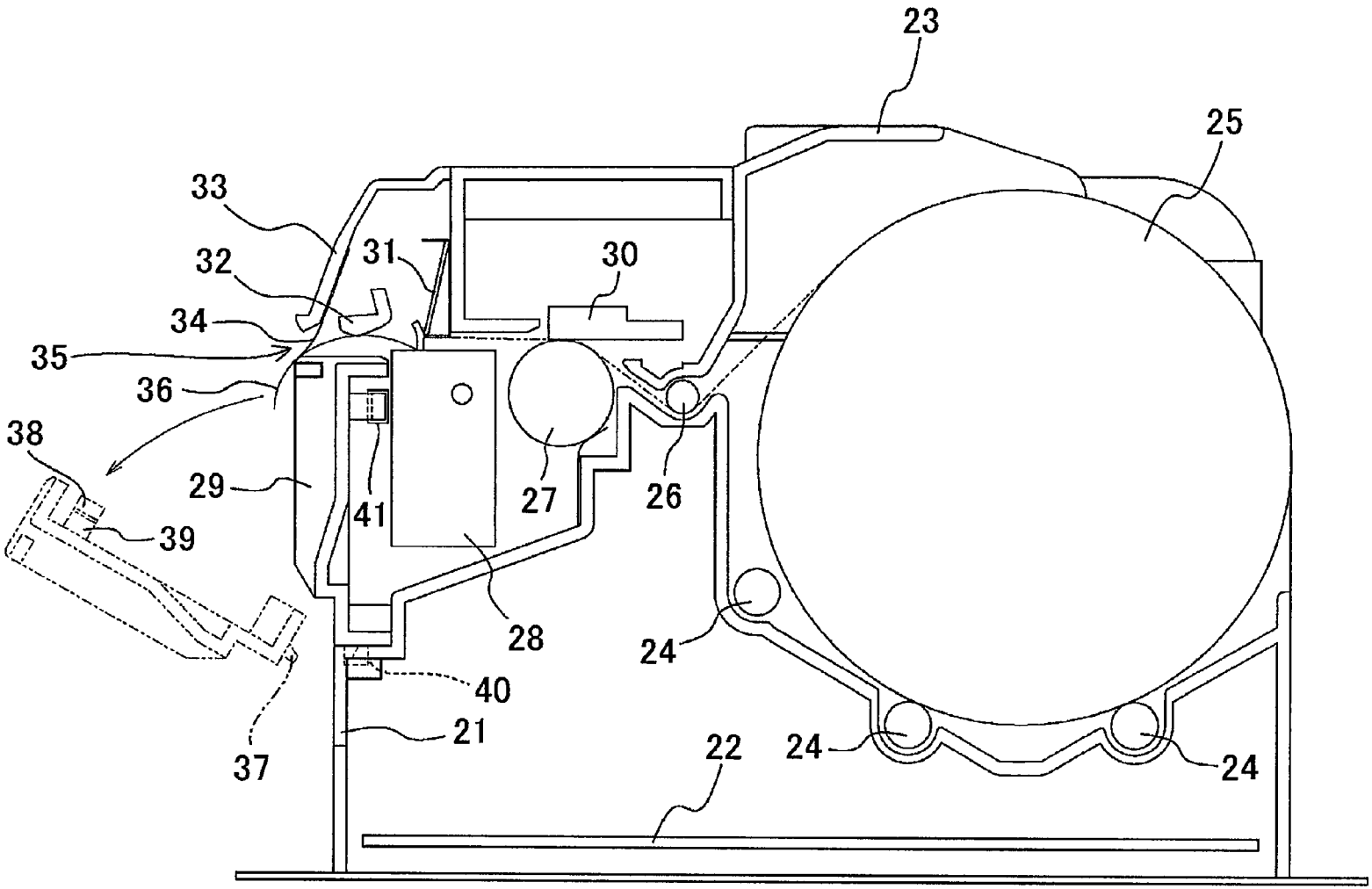
FIG. 2 is a schematic longitudinal sectional view of a printer according to a preferred embodiment of this invention.
Figure 3:
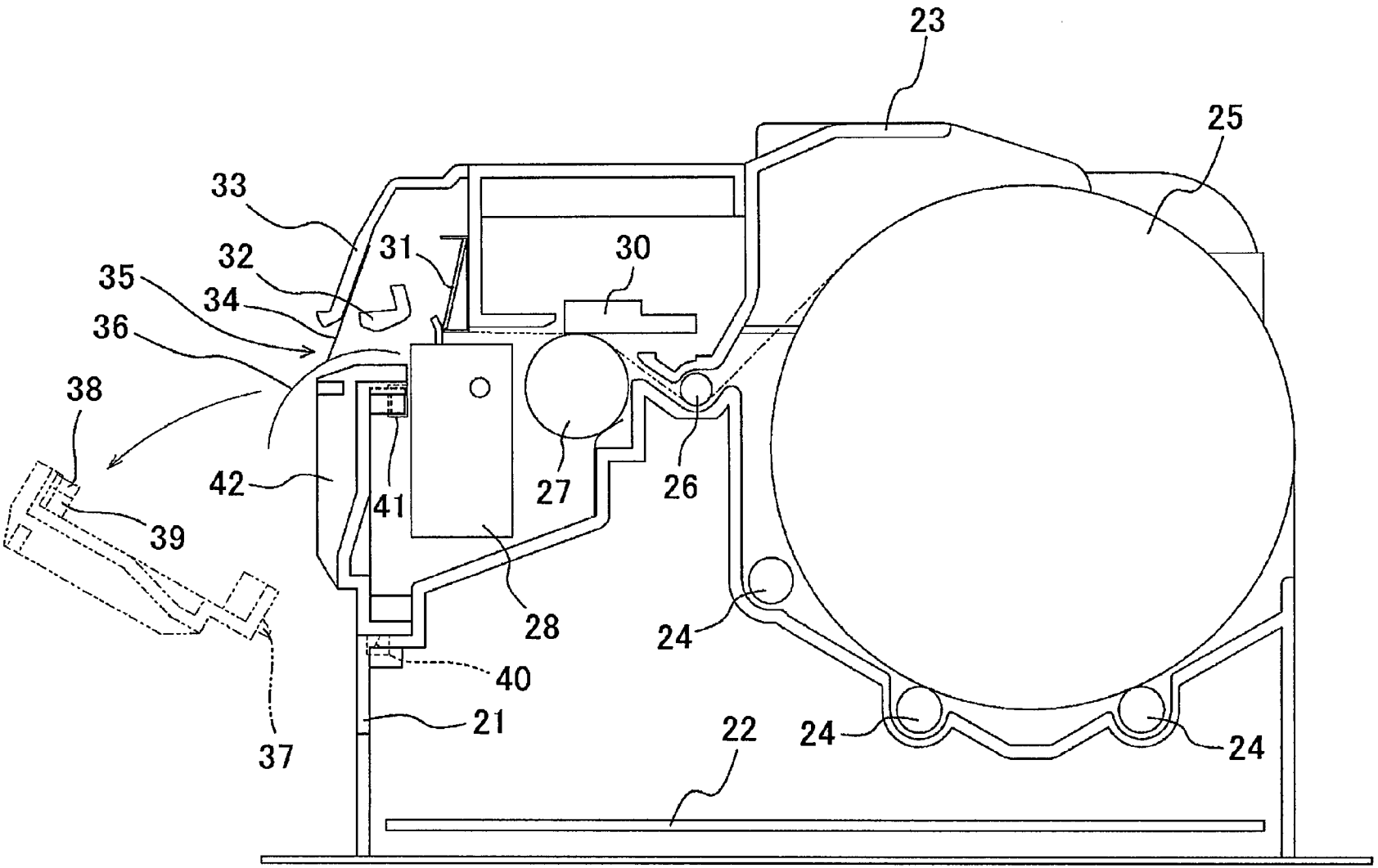
FIG. 3 is a schematic longitudinal sectional view of the printer of FIG. 2 after changing specifications thereof.
Figure 4:
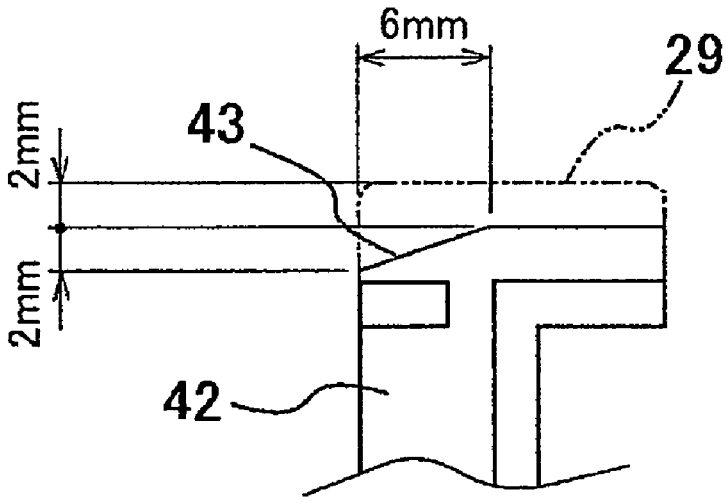
FIG. 4 is a view showing a difference between an exchangeable lower cover attached to the printer of FIG. 2 and another exchangeable lower cover attached to the printer of FIG. 3.

Referring to FIGS. 2 to 4, a detailed description will be made about a preferred embodiment of this invention.

FIG. 2 is a schematic longitudinal sectional view of a printer according to a preferred embodiment of this invention. The printer, for example, is used for a receipt printer of a POS (point-of-sale) terminal or the like.

The printer illustrated in FIG. 2 includes a lower frame 21 containing a control board 22 and an upper frame 23. The upper frame 23 is attached to the lower frame 21 by means of an open-shut axis (not shown) to be able to open and shut.

The lower frame 21 is fitted with a plurality of rollers 24 for supporting a receipt paper (or a roll paper) 25 so that the receipt paper can be rotated, a guide roller 26 for guiding the receipt paper 25 when the receipt paper 25 is carried, a platen 27, a movable-side cutter 28 and an exchangeable lower cover (or a first lower cover) 29.

On the other hand, the upper frame 23 is fitted with a printing head 30 facing the platen 27, a fixed-side cutter 31 composing a cutter mechanism together with the movable-side cutter 28, a paper guide 32 and an upper cover 33 on which a brush 34 is fixed.

The lower cover 29 defines, together with the upper cover 33, a discharge port 35 for discharging a printed slip 36. Particularly, the lower cover 29 defines at least a lower edge of the discharge port 35 without defining an upper edge of the discharge port 35. The upper cover 33 defines at least an upper edge of the discharge port 35. The brush 34 is provided to a periphery of the upper edge of the discharge port 35. Particularly, the brush 34 is fixed to the inside of the upper cover 33 to project into the discharge port 35 so that a tip of the brush 34 is in contact with an upper front edge or an upper surface of the lower cover 29. The brush 34 has proper flexibility so as not to impede transportation of the receipt paper 25 and is set to be at an acute angle with the upper surface of the lower cover 29.

Furthermore, the lower cover 29 is configured to be attachable to and detachable from the lower frame 21 without tools. Concretely, the lower cover 29 has a lower hook(s) (or a projection(s)) 37 formed on a bottom thereof and upper hooks 38 formed on tip portions of arms 39 formed at both upper sides. The lower frame 21 is provided with receiving portions (or hollows, windows or the like) 40 and 41 corresponding to the lower and the upper hooks 37 and 38. Elastic deformation of the arms 39, allows the lower cover 29 to be attached to or detached from the lower frame 21. Attaching and detaching of the lower cover 29 is possible in only condition that the upper frame 23 is opened. For example, the upper frame 23 is configured to be an obstacle to detaching the lower cover 29 when it is shut.

The upper surface of the lower cover 29 is approximately in parallel to a transporting direction of the receipt paper 25 and positioned slightly lower than a cutoff position of the cutter mechanism (28, 31). This is for transporting the receipt paper smoothly in consideration of a remaining rolled shape of the receipt paper. However, it is desirable that the upper surface of the lower cover 29 is as higher as possible to ensure that the brush 34 holds the printed slip 36.

Figure 1:
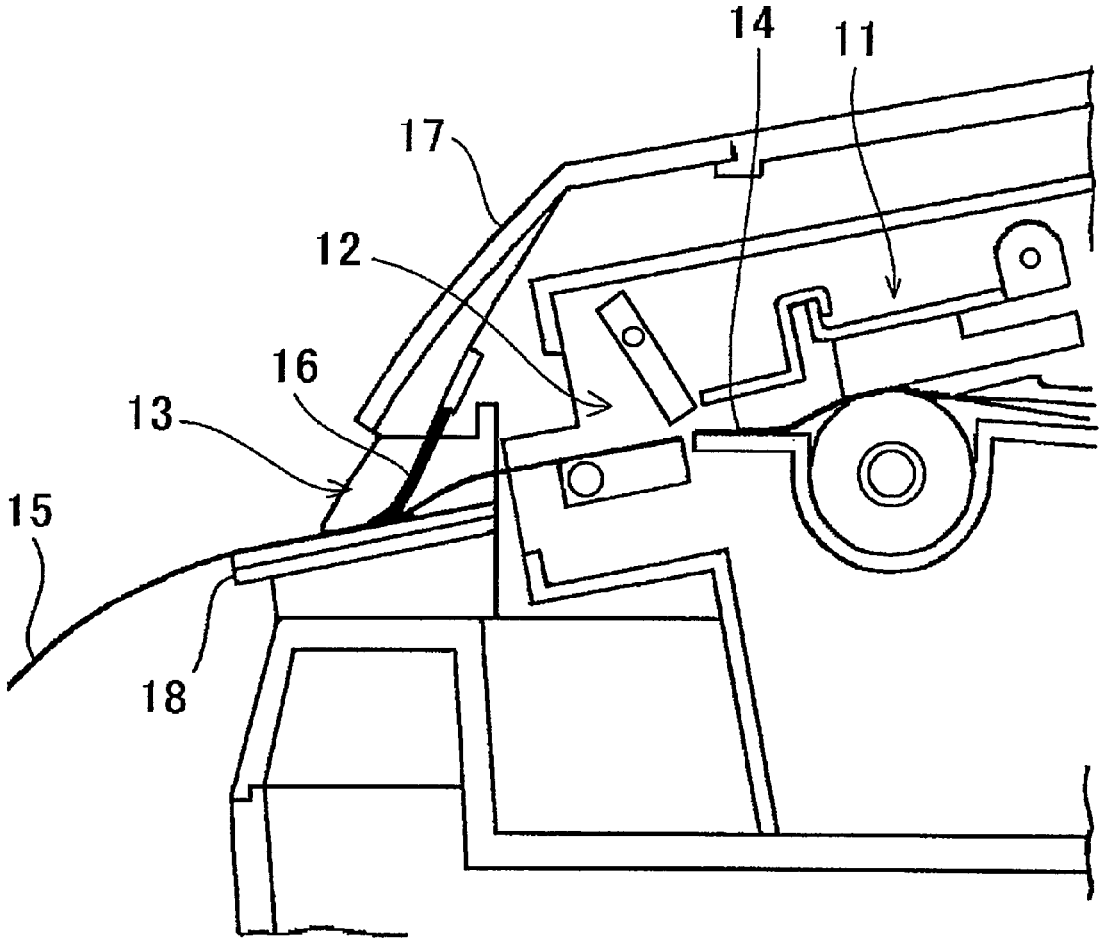
Fig.1 Related Art
FIG. 1 is a schematic longitudinal sectional view of a main part of a related printer.

Though the printer shown in FIG. 1 is of a specification for holding the printed slip 36, it can change to another specification for allowing the printed slip 36 to fall freely by exchanging the lower cover 29 for another one having a different shape. FIG. 3 shows the printer of the other specification for allowing the printed slip 36 to fall freely.

The printer illustrated in FIG. 3 includes an exchangeable lower cover (or a second lower cover) 42 which is different from the lower cover 29 in shape. However, the lower cover 42 can be attached to and detached from the lower frame 21 in place of the lower cover 29 of FIG. 2. Accordingly, the lower cover 42 has hooks (and arms) corresponding to hooks 37 and 38 (and arms 39) of the lower cover 29.

As illustrated in FIG. 4, the lower cover 42 is shorter (by 2 mm in this embodiment) than the lower cover 29 in an upward-downward direction. The lower cover 42 further has an inclined surface (with 6 mm width in this embodiment) 43 at the top thereof. The inclined surface 43 is formed to face the brush 34 at a distance. Due to the inclined surface 43, an angle between the brush 34 and the facing surface (i.e. the inclined surface 43) of FIG. 3 is smaller than that between the brush 34 and the facing surface (i.e. the upper surface) of FIG. 2. Therefore, even if the printed paper has various remaining rolled shape, it is allowed to fall freely.

By attaching the lower cover 42 to the lower frame 21, height (or length in vertical direction or in thickness direction of the printed slip 36) of the discharge port 35 become longer than that in the case where the lower cover 29 is attached to the lower frame 21. Hereby, clearance which is larger than the thickness of the printed slip 36 is obtained between the brush 34 and the lower cover 42 and thereby the printed slip 36 surely passes between the brush 34 and the lower cover 42 and falls freely.

Even when the lower cover 42 is taken away, the printed slip 36 falls freely. However, the movable-side cutter 28 is exposed to the outside in this case. Accordingly, the lower cover 42 is necessary for accident and mischief prevention. When the height of the discharge port 35 is too high, the discharge port 35 allows a finger to insert into the inside of the printer. This causes an accident and a breakdown of the printer, too. Accordingly, the shape of the lower cover 42 should be designed so that the height of the discharge port 26 is not long too much. In this embodiment, since the inclined surface 43 is formed at the top of the lower cover 42, the discharge port 35 is wider at the outer side and narrower at the inner side. Consequently, it is possible to prevent the finger from inserting into the inside of the printer while the printed slip surely falls freely.

While this invention has thus far been described in conjunction with the preferred embodiment thereof, it will readily be possible for those skilled in the art to put this invention into practice in various other manners. For example, hooks may be formed at the lower frame 21 while receiving portions correspond to the hooks may be formed at the lower covers 29 and 42. At any rate, parts of the lower cover or the lower frame only have to be able to deformed elastically so that the lower cover is attachable to and detachable from the lower frame.

What is claimed is:

1. A printer which prints on a roll paper transported toward a discharge port and cuts the roll paper, the discharge port provided at a side surface of the printer so that a vertical direction thereof corresponds to a thickness direction of the roll paper, the printer comprising:

a brush provided on a periphery of an upper edge of the discharge port and projecting into the discharge port;

a first lower cover and a second lower cover; and the first lower cover and second lower cover selectively and exchangeably attached to the printer to define a lower edge of the discharge port, wherein the first lower cover is in contact with the brush when the first lower cover is selectively attached to the printer, and the second lower cover is away from the brush when the second lower cover is selectively attached to the printer, and wherein a change of length in the vertical direction of the discharge port is allowed by selectively exchanging the the first lower cover and the second lower cover.

2. A printer as claimed in claim 1, wherein the first lower cover has a surface which faces the brush to be at a first angle with the brush when the first lower cover is attached to the printer, and wherein the second lower cover has a surface which faces the brush to be at a second angle with the brush when the first lower cover is attached to the printer, the second angle being smaller than the first angle.

3. A printer as claimed in claim 2, wherein the first lower cover is configured to hold a cut roll paper while the second lower cover is configured to allow the cut roll paper to fall freely.

4. A printer as claimed in claim 1, wherein the first lower cover is configured to hold a cut roll paper while the second lower cover is configured to allow the cut roll paper to fall freely.

5. A printer as claimed in claim 1, wherein the exchangeable lower cover is provided with a first hook or a first receiving portion while a frame to which the exchangeable lower cover is attached is provided with a second receiving portion or a second hook which are corresponding to the first hook and the first receiving portion, respectively, and wherein the exchangeable lower cover is attachable to and detachable from the frame by elastic deformation of at least one of the exchangeable lower cover and the frame.

6. A specification changing method of a printer which prints on a roll paper transported toward a discharge port and which cuts the roll paper, comprising the step of:

previously providing the discharge port at a side surface of the printer so that a vertical direction thereof corresponds to a thickness direction of the roll paper;

previously providing a brush on a periphery of an upper edge of the discharge port to project into the discharge port;

providing a first lower cover and a second lower cover;

attaching an exchangeable lower cover to the printer to define a lower edge of the discharge port, the exchangeable lower cover selected from the first lower cover and the second lower cover, the first lower cover being in contact with the brush when the first lower cover is selectively attached to the printer, the second lower cover being away from the brush when the first lower cover is selectively attached to the printer, and exchanging the exchangeable lower cover between the first lower cover and the second lower cover allowing a change of length in the vertical direction of the discharge port, and thereby changing specifications of the printer between one for holding a cut roll paper with the first lower cover and the brush and the other for allowing the cut roll paper to fall freely through a space between the second lower cover and the brush.

* * * * *